US005486814A

United States Patent [19]

Quinones

[11] Patent Number: 5,486,814

[45] Date of Patent: Jan. 23, 1996

[54] BABY POOL GUARD ALARM

[76] Inventor: Sandra L. Quinones, 111 Canterbury Dr. W., West Palm Beach, Fla. 33407-1510

[21] Appl. No.: 321,144

[22] Filed: Oct. 11, 1994

[51] Int. Cl.[6] ..... G08B 21/00

[52] U.S. Cl. ..... 340/573; 340/604; 340/569

[58] Field of Search ..... 340/573, 566, 340/525, 569, 604

[56] References Cited

U.S. PATENT DOCUMENTS

| | | | |
|---|---|---|---|
| 4,203,097 | 5/1980 | Manning | 340/566 |
| 4,408,193 | 10/1983 | Millen | 340/566 |
| 4,510,487 | 4/1985 | Wolfe et al. | 340/566 |
| 4,571,579 | 2/1986 | Woolley | 340/566 |
| 4,604,610 | 8/1986 | Baker et al. | 340/566 |
| 5,030,152 | 7/1991 | Carr et al. | 441/89 |
| 5,138,300 | 8/1992 | Chance | 340/573 |
| 5,255,306 | 11/1993 | Melton | 340/573 |
| 5,289,163 | 2/1994 | Perez | 340/573 |
| 5,389,915 | 2/1995 | Chen | 340/573 |

*Primary Examiner*—John K. Peng
*Assistant Examiner*—Albert K. Wong
*Attorney, Agent, or Firm*—Quarles & Brady

[57] ABSTRACT

The invention relates to a swimming pool monitoring device which can be attached to the wrist or other place on a child to constantly transmit an electromagnetic radio wave of a desired frequency. The monitoring device contains a water submersion sensor, which will deactivate the transmitter upon submersion. Whenever transmissions from the monitoring device are interrupted, due to immersion or battery failure, a receiver will sense this condition and activate an alarm, which may be visual, audible, or a signal that is relayed to further remote wireless equipment such as a pager or telephone dialing equipment that is used to dial an emergency telephone number.

5 Claims, 3 Drawing Sheets

BABY POOL GUARD ALARM

CROSS-REFERENCE TO DISCLOSURE DOCUMENT

The invention herein was the subject of Disclosure Document 353685, filed Apr. 25, 1994.

BACKGROUND OF THE INVENTION

1. Field of the Invention

The invention relates to a remote, wireless monitoring device and alarm system for alerting adults in the event a child enters a swimming pool or other body of water.

2. Description of Prior Art

Swimming pool alarms and immersion sensors are shown in the patents such as Woolley, U.S. Pat. No. 4,571,579; Wolfe, deceased et al., U.S. Pat. No. 4,510,487; Millen, U.S. Pat. No. 4,408,193; Baker et al., U.S. Pat. No. 4,406,610; Manning, U.S. Pat. No. 4,203,097; Carr et al., U.S. Pat. No. 5,030,152, and Chance, U.S. Pat. No. 5,138,300.

Some devices have been attached to a child using wrist straps while others have been placed in a pool independent of the occupants. Chance, U.S. Pat. No. 5,138,300, shows a water immersion alarm system that attaches a unit with a water sensor and radio frequency transmitter on the wrist of a child. When the sensor is immersed, the transmitter is activated to send a radio frequency signal. The unit is typically powered by a battery. If the battery or transmitter fails, no signal will be transmitted, even if an immersion occurs. Therefore, it is seen that this system does not satisfy all types of alarm situations that may occur.

SUMMARY OF THE INVENTION

The invention relates to a monitoring device which can be attached to the wrist or other place on the child to continuously transmit an electromagnetic radio wave of a desired frequency. The monitoring device contains a water immersion sensor, which will deactivate the transmitter upon immersion of the monitoring device.

Whenever the "transmit" signal is interrupted, due to immersion or battery failure, a receiver will sense this condition and activate an alarm, which may be visual, audible, or a signal that is relayed to further remote wireless equipment such as a pager or used to initiate a report to an emergency telephone number.

One object of the present invention is to improve the reliability of a swimming pool alarm system.

Another object of the invention is to detect battery or transmitter failures in the remote monitoring devices.

Another object is to provide additional remote devices which are served by the alarm signal.

Other objects and advantages, besides those discussed above, will be apparent from the description of the preferred embodiment, which follows. In the description, reference is made to the accompanying drawings, which form a part hereof, and which illustrate examples of the invention. Such examples, however, are not exhaustive of the various embodiments of the invention, and, therefore, reference is made to the claims which follow the description for determining the scope of the invention.

DETAILED DESCRIPTION OF THE PREFERRED EMBODIMENTS

Figure 1:
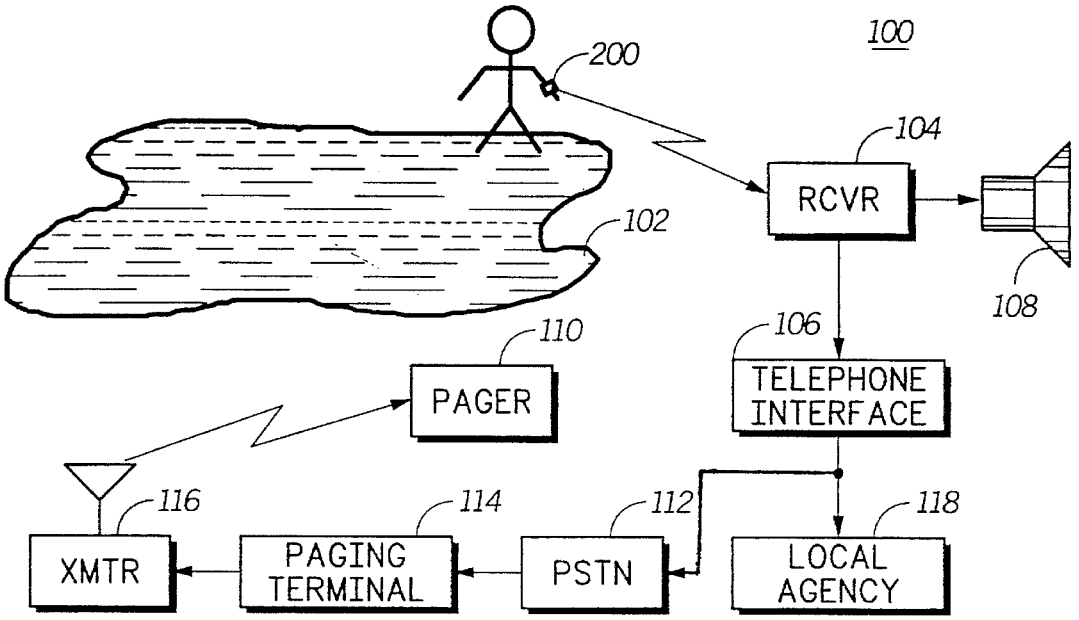
FIG. 1 is a schematic diagram of a swimming pool alarm system of the present invention.
Figure 2:
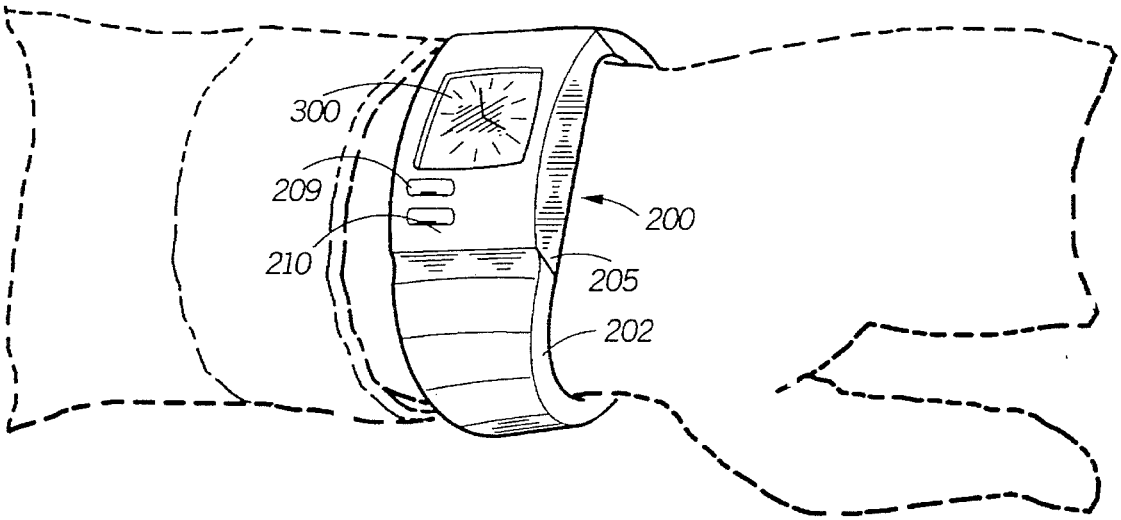
FIG. 2 is a detail perspective view of a monitoring device worn by the person shown in FIG. 1.

Referring to FIGS. 1 and 2, the invention is incorporated in a monitoring device 200 for use in monitoring entry into a body of water 102 such as a swimming pool. The device 200 includes a body casing 205 that is typically attached to the wrist or ankle of the wearer using band 202. The monitoring device 200 may optionally take the form of an electronic watch seen in FIG. 2 with watchface 300, on/off button 209 and programming button 210.

Figure 3:
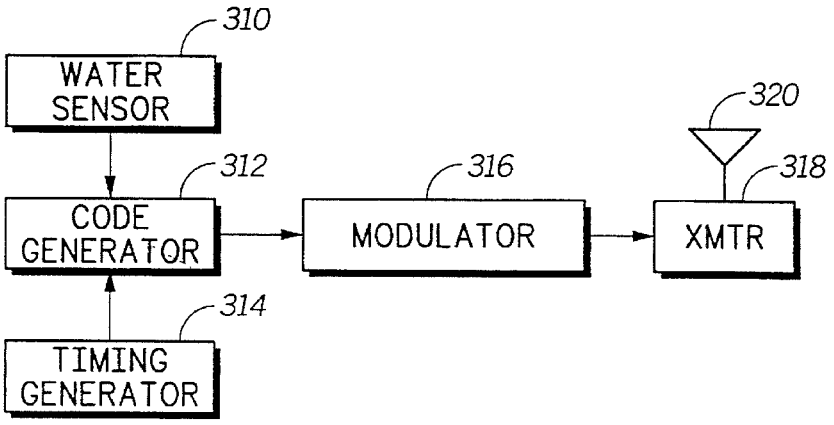
FIG. 3 is a detail schematic diagram of the device of FIG. 2.

Not shown in FIG. 2, is a water immersion sensor 310 and other internal components of device 200, which are seen in more detail in FIG. 3. As seen there, a code generator 312 provides an identification number or ID code for the monitoring device. A timing generator 314 provides time base signals for driving the other circuitry on the unit. Not shown is a battery, which acts as a source of power for the circuitry 312, 314. The timing signals and ID code are inputs to a modulator 316 which converts the signal from a digital form to an analog modulated form for transmission as a radio signal by transmitter 318. The frequency of the radio signal can be any frequency which is allowed or permitted for signaling of wireless devices over short distances. The signal is transmitted through antenna 320 and converted to an electromagnetic radio wave.

The water immersion sensor 310 acts as an enabler for the circuitry 312, 314, 316 until such time as the device is submerged, when it disables all or a portion of the circuitry, such that the normal transmission of the ID code by transmitter 318 to a receiving station is interrupted.

Figure 5:
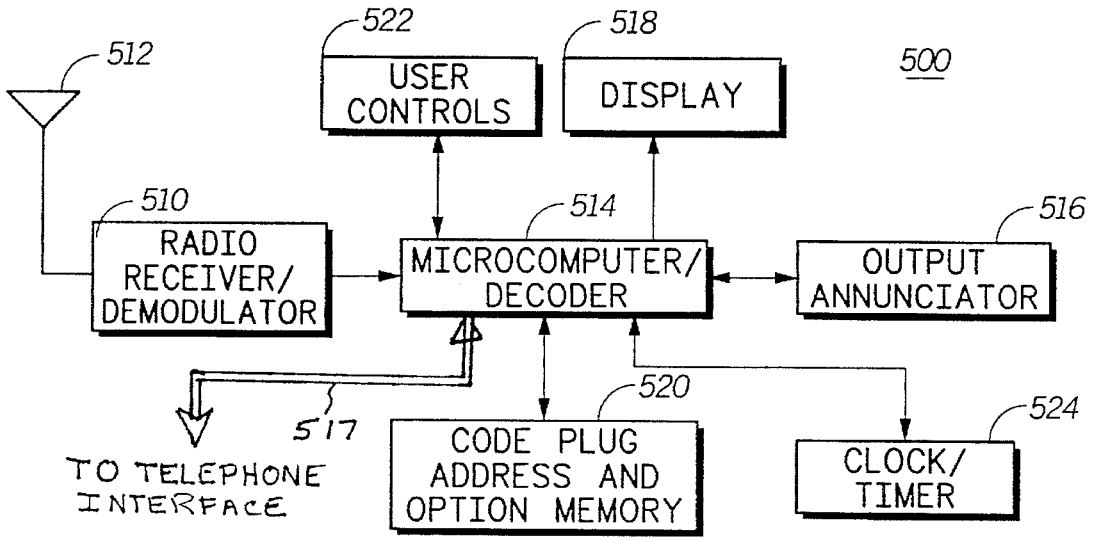
FIG. 5 is a detail schematic diagram of a receiver seen in FIG. 1.

Receiver station 104 in FIG. 1 includes elements seen in FIG. 5, such as antenna 512 and receiver/demodulator 510 which converts the received radio signals to digital signals that can be processed by microcomputer/decoder 514. This circuit 514 is driven by timing signals from clock/timer 524. The receiving station 104 may have user controls 522, and a visual display, as well as audio annunciator alarm 516 (such as element 108 in FIG. 1). Finally, communication link 517 is provided to allow the receiver station 104 to signal a telephone interface (element 106 in FIG. 1).

As seen in FIG. 5, a circuit such as an optional plug-in memory 520 is provided with the ID code of the monitoring device, as well as the name and address of the residence, and certain emergency telephone numbers.

Figure 4:
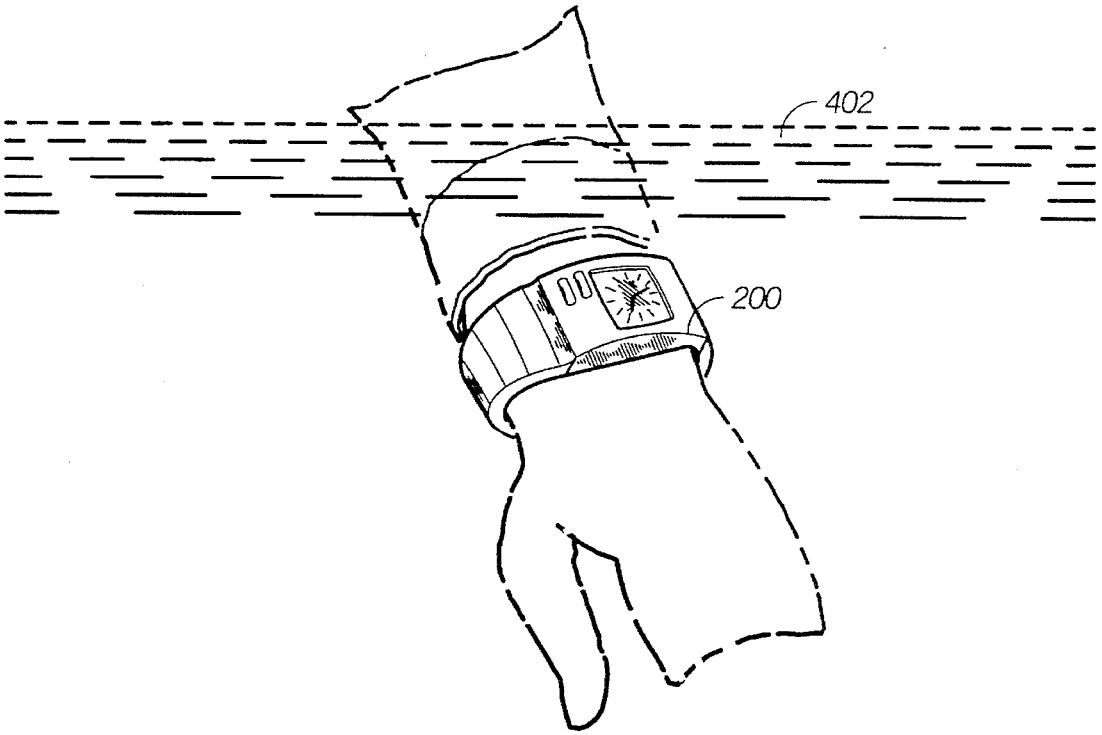
FIG. 4 is a detail perspective view of the device of FIG. 2 when submerged in a body of water.

The operation of the entire system will now be explained with reference to FIGS. 1 through 4. The transmitter 318 (FIG. 3) in monitoring device 200 is normally transmitting an electromagnetic radio wave to receiver 104, unless the transmitter 318 (FIG. 3) is deactivated in response to detection of an underwater condition, or unless the transmitter 318 is deactivated in response to failure of the power source. An underwater condition occurs as illustrated in FIG. 4, when the entire device is fully submerged below water line 402.

The interruption of transmission between device 200 and receiver 104 (FIG. 1), causes a signal to be emitted from audible alarm 108, and also signals a telephone interface 106 (through communication line 517) to dial a local agency 118 such as the police or "911", or to dial a telephone number of a central paging station 112. This station 112 will receive the call and signal a specific paging terminal 114 having a local area transmitter 116, which will transmit radio waves to a pager unit 110 carried by an adult or monitoring individual. The pager unit 110 provides a message concerning the identification of the individual being monitored and the interruption of the transmission signal which signals the need for remedial action.

This has been a description of an of how the invention can be carried out. Those of ordinary skill in the art will recognize that various details may be modified in arriving at other detailed embodiments, and these embodiments will come within the scope of the invention.

Therefore, to apprise the public of the scope of the invention and the embodiments covered by the invention, the 30 following claims are made.

I claim:

1. A fail safe alarm control device for detecting entry into body of water, including a swimming pool, the alarm control device being powered by a power source and the alarm control device comprising:

a device body;

means for attaching said device body to a portion of a human body;

an underwater sensor disposed in said device body for sensing a water condition when said device body is submerged in water;

a radio transmitter disposed within said device body, said radio transmitter receiving power from the power source to maintain a condition wherein said radio transmitter is normally transmitting a coded signal, unless said radio transmitter is deactivated in response to detection of a water condition by said underwater sensor, or unless said radio transmitter is deactivated in response to failure of the power source;

a receiver for receiving said coded signal from said radio transmitter; and an alarm means that is activated in response to interruption in reception of said coded transmission from said radio transmitter to said receiver, whereby a failure in reception of said coded transmission is automatically detected.

2. The alarm control device of claim 1, wherein said alarm means includes an alarm indicator which is visually perceptible by a human when said alarm means is activated.

3. The alarm control device of claim 1, wherein said alarm means includes an alarm indicator which is audibly perceptible by a human when said alarm means is activated.

4. The alarm control device of claim 1, wherein said alarm means telephonically communicates with a central paging station for generating a paging signal to be received by a pages, in response to interruption of said coded transmission from said radio transmitter to said receiver.

5. The alarm control device of claim 1, wherein said alarm means includes means for dialing an emergency telephone number.

* * * * *